US007896683B1

(12) United States Patent
Ratzlaff et al.

(10) Patent No.: US 7,896,683 B1
(45) Date of Patent: Mar. 1, 2011

(54) CONNECTOR ASSEMBLIES CONFIGURED TO PREVENT DAMAGE TO CONTACTS DURING MATING AND DEMATING

(75) Inventors: Thomas D. Ratzlaff, Menlo Park, CA (US); Inho Myong, Newark, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 14 days.

(21) Appl. No.: 12/257,107

(22) Filed: Oct. 23, 2008

(51) Int. Cl.
*H01R 13/64* (2006.01)

(52) U.S. Cl. ..... 439/374; 439/680

(58) Field of Classification Search ..... 439/374–378, 439/526, 651, 680
See application file for complete search history.

(56) References Cited

U.S. PATENT DOCUMENTS

| | | | | |
|---|---|---|---|---|
| 2,750,571 | A | 6/1956 | Schmier | |
| 3,671,921 | A | 6/1972 | Baker et al. | |
| 4,526,435 | A | 7/1985 | Borne et al. | |
| 4,657,331 | A | 4/1987 | Coldren | |
| 4,764,130 | A | 8/1988 | DiClemente | |
| 4,960,387 | A | 10/1990 | Davis et al. | |
| 4,986,769 | A | 1/1991 | Adams, III et al. | |
| 5,073,127 | A | 12/1991 | Daly et al. | |
| 5,244,415 | A | 9/1993 | Marsilio et al. | |
| 5,282,757 | A | 2/1994 | Maeda | |
| 5,431,577 | A | 7/1995 | Lincoln | |
| 5,480,329 | A | 1/1996 | Karlstrom et al. | |
| 5,613,881 | A | 3/1997 | Ichida et al. | |
| 5,890,931 | A | 4/1999 | Ittah et al. | |
| 6,247,978 | B1 | 6/2001 | Wu | |
| 6,354,878 | B1 | 3/2002 | Kropa et al. | |
| 6,416,346 | B1 | 7/2002 | Nakamura | |
| 6,478,631 | B1 | 11/2002 | Dutton et al. | |
| 6,524,135 | B1 | 2/2003 | Feldman et al. | |
| 6,840,789 | B2 | 1/2005 | Shibata | |
| D523,399 | S | 6/2006 | Sakamaki et al. | |
| 7,059,892 | B1 | 6/2006 | Trout | |
| 7,137,848 | B1 | 11/2006 | Trout et al. | |
| 7,294,010 | B1 * | 11/2007 | Shaikh | 439/374 |
| 7,300,317 | B2 | 11/2007 | Dillon et al. | |
| 7,303,438 | B2 * | 12/2007 | Dawiedczyk et al. | 439/607 |
| 7,318,757 | B1 | 1/2008 | Minich | |
| 2001/0016456 | A1 | 8/2001 | Taguchi et al. | |

(Continued)

FOREIGN PATENT DOCUMENTS

DE 9312131 U1 2/1994

(Continued)

OTHER PUBLICATIONS

International Search Report for International Application No. PCT/US2009/005755, mailed Dec. 30, 2009.

(Continued)

*Primary Examiner* — Khiem Nguyen

(57) ABSTRACT

A connector assembly that includes a plug connector and a receptacle connector configured to mate with each other. The plug connector has a connector body including shroud with socket contacts received therein. The shroud also includes ribs and wing guides that extend in directions that are generally perpendicular to each other. The receptacle connector has walls that define a cavity that has a complementary shape for receiving the connector body. The walls are configured to direct the connector body into the cavity such that socket contacts within the plug connector engage pin contacts within the receptacle connector. The wing guide and the rib are configured to prevent damage to the pin contacts when the connector body is erroneously inserted into the receptacle connector.

20 Claims, 7 Drawing Sheets

U.S. PATENT DOCUMENTS

2005/0118883 A1 6/2005 Kim

FOREIGN PATENT DOCUMENTS

| | | | |
|---|---|---|---|
| DE | 19813458 | A1 | 10/1998 |
| EP | 1049214 | A1 | 11/2000 |
| GB | 2133638 | A | 7/1984 |
| GB | 2134724 | A | 8/1984 |
| GB | 2384630 | A | 7/2003 |
| WO | WO-87/07088 | A1 | 11/1987 |
| WO | WO-99/62145 | A1 | 12/1999 |
| WO | WO-2008/091253 | A1 | 7/2008 |

OTHER PUBLICATIONS

International Search Report for International Application No. PCT/US2009/05766, mailed Jan. 7, 2010.

International Search Report for International Application No. PCT/US2009/005736, Mar. 18, 2010.

International Search Report for International Application No. PCT/US2009/005735, Jan. 25, 2010.

* cited by examiner

CONNECTOR ASSEMBLIES CONFIGURED TO PREVENT DAMAGE TO CONTACTS DURING MATING AND DEMATING

CROSS-REFERENCES TO RELATED APPLICATION

The present application includes subject matter related to subject matter disclosed in U.S. patent application Ser. No. 12/257,132, U.S. patent application Ser. No. 12/257,166 (now U.S. Pat. No. 7,544,084, issued Jun. 9, 2009), and U.S. patent application No. 12/257,187, filed contemporaneously with the present application, all of which are incorporated by reference in their entirety.

BACKGROUND OF THE INVENTION

The subject matter herein relates generally to connector assemblies, and more particularly, to connector assemblies that include mateable plug and receptacle connectors that are configured to prevent damage to the contacts held within one of the connectors during the mating and demating process.

Connector assemblies generally include two connectors, such as a plug and a receptacle, that are mated together. The receptacle includes a cavity that may have free-standing mating or pin contacts therein that are configured to engage with corresponding socket contacts when the plug is inserted into the receptacle. However, the cavity may have a size and shape that places the pin contacts at risk of being damaged from scooping. "Scooping" occurs when a shroud or another part of the plug connector shell is erroneously inserted into the cavity of the receptacle connector shell in a direction that is transverse to the appropriate loading direction. Scooping may also be caused by one of the walls of the plug connector shell sliding along the wall of the receptacle connector shell defining the cavity at a skewed angle to the loading direction. During scooping the plug connector shell may strike the exposed, free-standing pin contacts, which may cause permanent deformation such that the pin contacts may no longer be capable of forming a connection with the corresponding contacts in the plug connector. This damage can also be caused by the socket contact insert striking the exposed, free-standing pin contacts.

One known connector assembly that is configured to prevent scooping is described in U.S. Pat. No. 6,416,346 to Nakamura. The connector assembly includes a male housing having a hood member that is configured to receive a female housing having a hood member that is smaller than the male hood member. The female hood member includes ribs projecting outwardly therefrom that are configured to be inserted into grooves of the male hood member. The positions of the ribs and grooves prevent the housings from being fitted together in a misaligned manner. One problem with the connector assembly disclosed in the Nakamura patent is that the plug and receptacle connector housings need to be precisely aligned before the two are mated together.

Accordingly, there is a need for connector assemblies that prevent the mating contacts from being damaged when the connectors are mated or demated. A need also remains for connector assemblies that correct misalignment during mating.

BRIEF DESCRIPTION OF THE INVENTION

In one embodiment, a connector assembly is provided that includes a first connector that extends along a mating axis from a mating end. The first connector includes a connector body that has a shroud including a longitudinal side and a lateral side meeting at a shroud corner. The longitudinal and lateral sides extend along the mating axis. The first connector also includes pin contacts received in the shroud and a rib that projects away from the longitudinal side. The rib has a position proximate to the shroud corner. The first connector also has a wing guide that projects a distance from the lateral side to a distal end and is positioned proximate to the shroud corner. The rib and the wing guide extend in directions that are generally perpendicular to each other. The connector assembly also includes a second connector that has walls defining a cavity. The second connector includes a mating end with an opening for accessing the cavity and an array of mating socket contacts arranged therein. The cavity has a complementary shape for receiving the connector body. The walls of the second connector direct the connector body into the cavity such that the socket contacts engage the pin contacts. The position of the wing guide and the position of the rib are configured to prevent the pin contacts from being damaged when the connector body is erroneously inserted into the second connector.

Optionally, the wing guide projects from the lateral side at the shroud corner such that the wing guide is flush with the longitudinal side. The first connector may include a pair of longitudinal sides where each longitudinal side has an unequal number of ribs with respect to the other longitudinal side. The longitudinal sides may be generally planar. The pin contacts within the second connector may be distributed evenly and continuously throughout a substantial portion of the width of the cavity.

In another embodiment, a connector assembly that includes a first connector and a second connector configured to mate together is provided. The first connector has a front mating end and a back end and a cavity that extends therebetween. The cavity includes socket contacts therein and is defined by a longitudinal wall and a lateral wall that meet each other at a cavity corner. The longitudinal wall includes a channel that extends alongside the cavity. The second connector includes a connector body that has a shroud including pin contacts configured to engage the mating socket contacts when the first and second connectors are properly mated. The shroud includes a longitudinal side and a lateral side that meet at a shroud corner. The shroud corner is configured to slide along the cavity corner. The second connector also includes a rib that projects away from the longitudinal side and that is configured to slide within the channel of the first connector. The second connector also includes a wing guide that projects a distance from the lateral side to a guide edge. The rib and the wing guide extend in directions that are generally perpendicular to each other. The guide edge is curved such that the guide edge facilitates shifting the second connector from a longitudinally misaligned position in which the rib is misaligned with the channel to a longitudinally aligned position in which the rib is aligned with the channel.

Optionally, the guide edge initially projects from the lateral side in a substantially perpendicular direction with respect to the lateral side and then curves away to extend substantially parallel to the lateral side. The wing guide may project from the lateral side at the corner of the shroud such that the wing guide is flush with the longitudinal side. Moreover, the rib may have a tip at the mating end that is rounded. The tip of the rib and the guide edge may be configured to cooperate with each other to align the second connector when the second connector is longitudinally misaligned with the first connector.

DETAILED DESCRIPTION OF THE INVENTION

Figure 1:
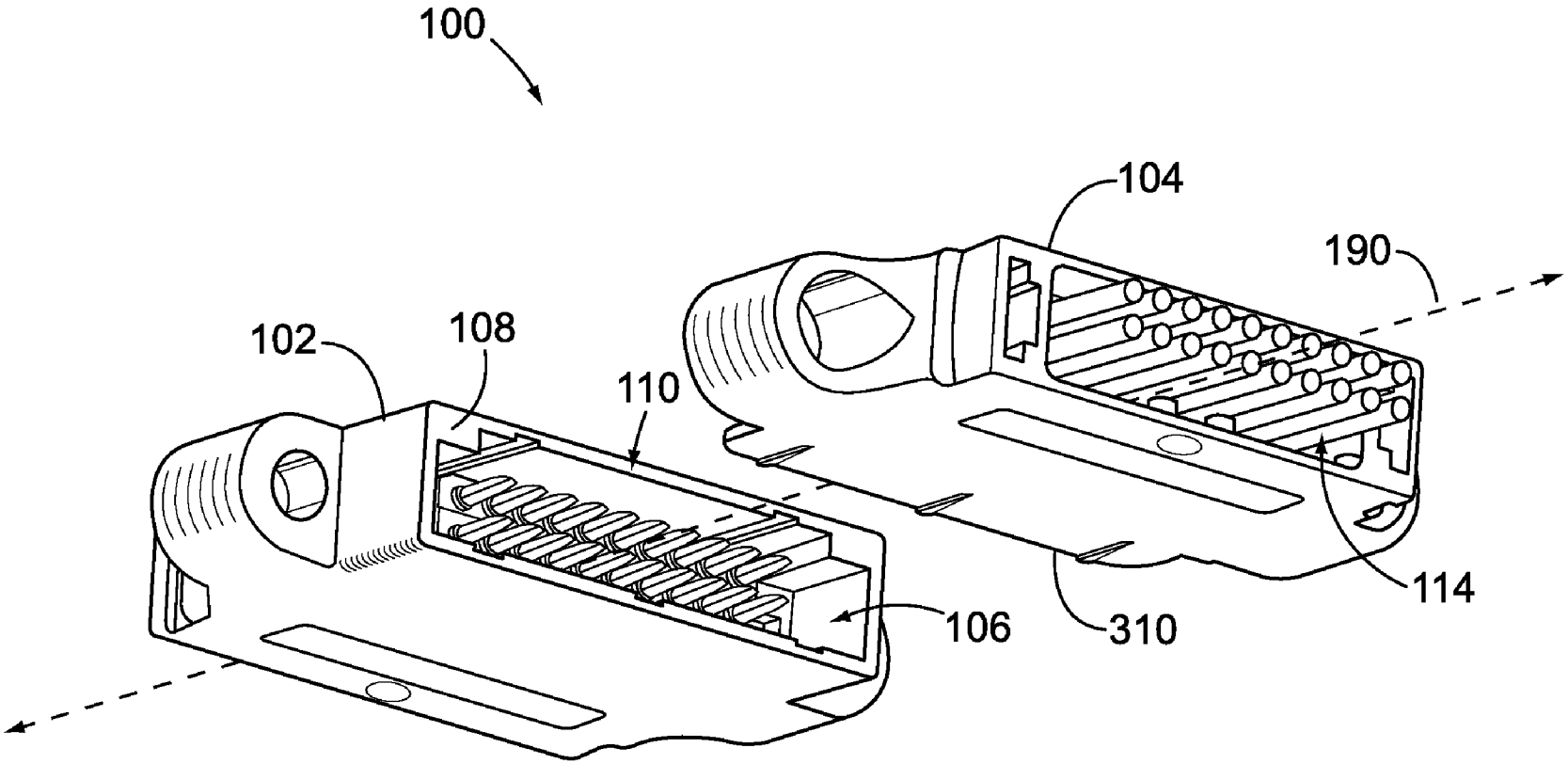
FIG. 1 is a bottom perspective view of a connector assembly formed in accordance with one embodiment.

FIG. 1 is a perspective view of a connector assembly 100 formed in accordance with one embodiment. The connector assembly 100 includes a receptacle connector 102 and a plug connector 104 that are configured to mate with each other and establish an electrical and/or optical connection. The receptacle connector 102 includes a cavity 106 that houses one or more mating pin contacts 160 (shown in FIG. 2). The receptacle connector 102 also includes a mating end 108 that defines an opening 110 for accessing the cavity 106. The plug connector 104 includes a shroud 310 that holds a socket module 318 (shown in FIG. 4) having socket contacts 319 (shown in FIG. 4) therein. Both of the receptacle and plug connectors 102 and 104 may include one or more cables and/or conductors 114 that are communicatively coupled to the contacts of the receptacle and plug connectors 102 and 104. (Tile cables and/or conductors 114 are only shown with respect to the plug connector 104.) To mate the receptacle and plug connectors 102 and 104, the receptacle and plug connectors 102 and 104 are generally aligned with one another along a mating axis 190 and moved toward each other. When in proper alignment, the shroud 310 will advance into the cavity 106 where the pin contact(s) 160 and corresponding socket contact(s) 319 will engage each other. Thus, the receptacle and plug connectors 102 and 104 may mate with each other and establish a communicative coupling between devices, systems, other cables or conductors, etc.

As will be discussed in further detail below, the receptacle and plug connectors 102 and 104 are configured to prevent scooping or damage of the pin contacts 160 when the shroud 310 or some part thereof is inserted into the cavity 106. For example, when the receptacle and plug connectors 102 and 104 are erroneously or improperly aligned while attempting engagement, the walls surrounding the opening 110 are configured to stop the shroud 310 from advancing into the cavity 106 where the shroud 310 or the socket module 318 can damage the pin contacts 160. In addition to preventing scooping, the opening 110 and the surrounding walls may also be configured to facilitate redirecting or aligning the receptacle connector 102 with the plug connector 104.

The receptacle and plug connectors 102 and 104 may be constructed by a variety of methods and may include various accessories attached thereto such as those methods and accessories described in U.S. patent application Ser. No. 12/257,187, which is incorporated by reference in its entirety. The receptacle connector 102 and/or the plug connectors 104 may be configured to hold one or more modules, such as the contact module 125 and the socket module 318 described below, within the corresponding connector as described in U.S. patent application Ser. No. 12/257,132, which is incorporated by reference in its entirety. In addition, the receptacle connector 102 and/or the plug connector 104 may be constructed by a two or more shells that are held together as described in U.S. patent application Ser. No. 12/257,166, which is incorporated by reference in its entirety.

Figure 2:
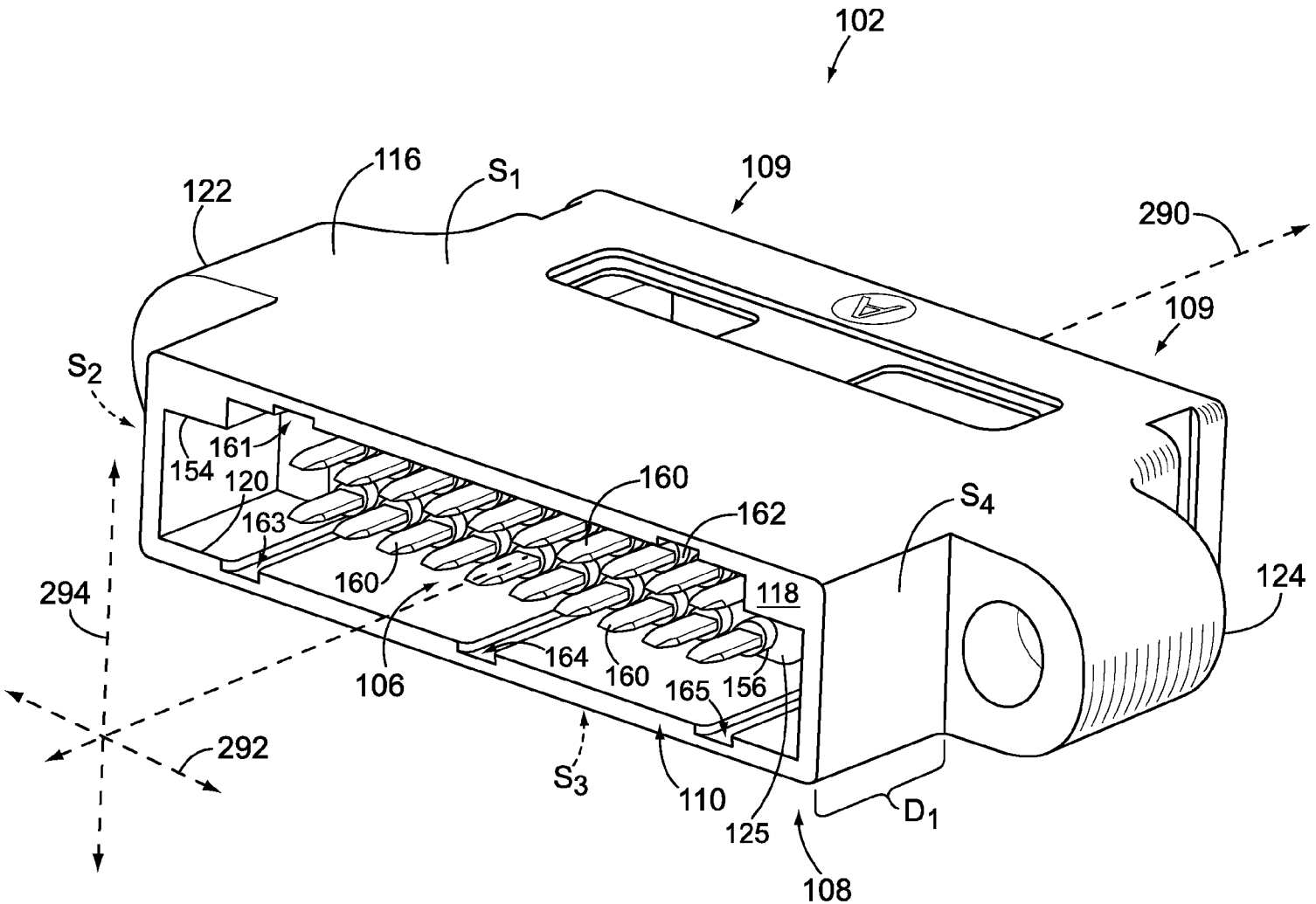
FIG. 2 is a front perspective view of a receptacle connector that may be used with the connector assembly shown in FIG. 1.
Figure 3:
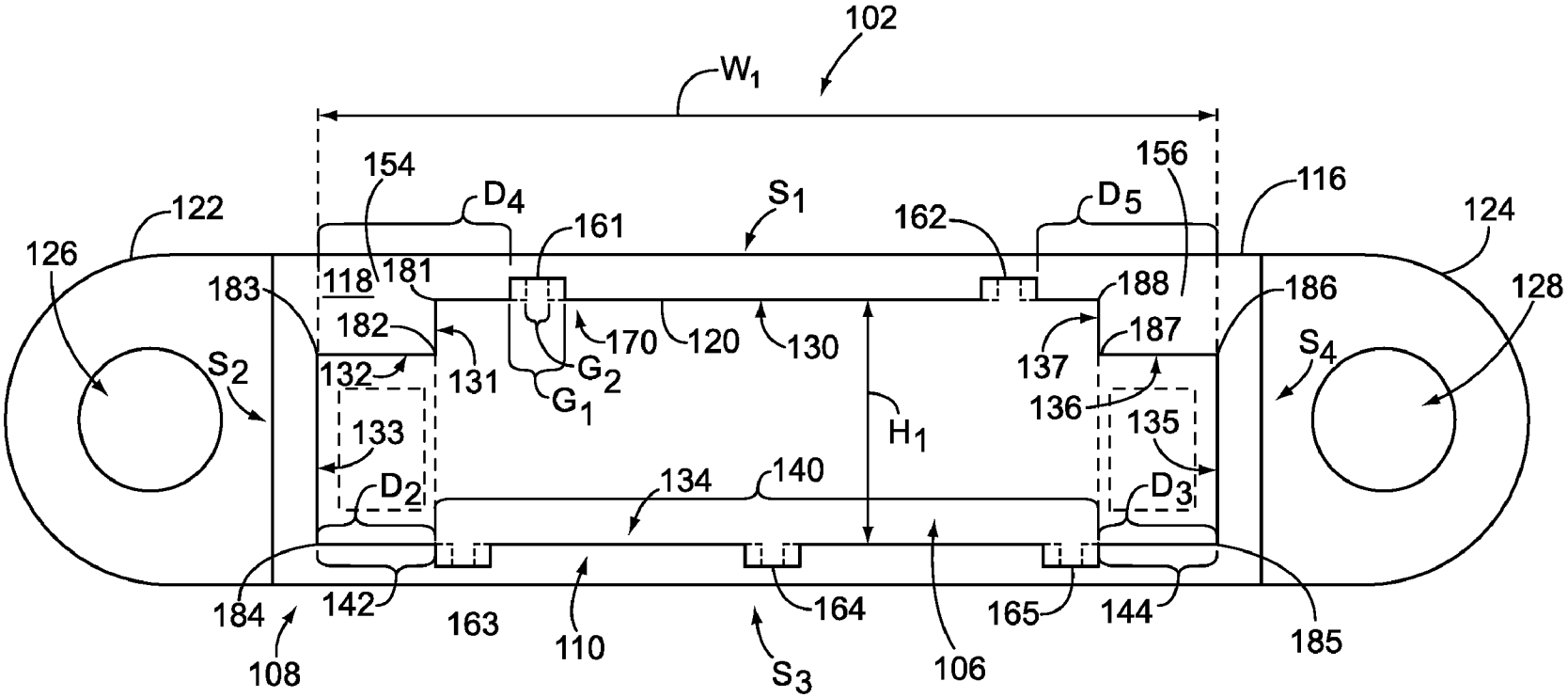
FIG. 3 is a front planar view of the receptacle connector shown in FIG. 2.

FIGS. 2 and 3 are a front perspective view and a front planar view, respectively, of the receptacle connector 102. As shown in FIG. 2, the receptacle connector 102 is oriented with respect to a central axis 290, a longitudinal axis 292, and a lateral axis 294. The receptacle connector 102 includes a housing 116 that may be assembled from separate parts (e.g., two shells) or, alternatively, may be integrally formed/molded. The housing 116 includes a plurality of sides $S_1$-$S_4$ which extend substantially parallel to the central axis 290 in a front-to-back direction. The sides $S_1$ and $S_3$ are longitudinal sides that may extend parallel to a plane formed by the longitudinal and central axes 292 and 290, and the sides $S_2$ and $S_4$ are lateral sides that may extend parallel to a plane formed by the lateral and central axes 294 and 290.

Optionally, the housing 116 may include a pair of fastener mounts 122 and 124 that project from the sides $S_2$ and $S_4$, respectively. The fastener mounts 122 and 124 include holes 126 and 128, respectively, where fasteners (not shown) may be inserted to couple or attach with corresponding holes 316 and 314 (shown in FIG. 4) from the plug connector 104 (FIG. 1). As shown, each fastener mount 122 and 124 has a planar face along a plane formed by the longitudinal and lateral axes 292 and 294 that is offset a distance $D_1$ (FIG. 2) from the mating end 108.

The cavity 106 extends along the central axis 290 between the mating end 108 and a back end 109 (FIG. 2). The mating end 108 has a substantially rectangular shape and a mating surface or face 118 that defines the opening 110 along an opening edge 120. The mating face 118 extends along the plane formed by the longitudinal and lateral axes 292 and 294. As shown in FIG. 3, the cavity 106 includes a height $H_1$ and a width $W_1$. In the exemplary embodiment, the width $W_1$ is substantially greater than the height $H_1$. As used herein, the term "substantially greater than" means that the width is more than two times the size of the height. For example, in one embodiment, the width is at least four times greater than the height.

As shown in FIG. 3, the cavity 106 is surrounded by a plurality of walls 130-137 including longitudinal walls 130, 132, 134, and 136 that extend parallel to the longitudinal axis 292 (FIG. 2) and lateral walls 131, 133; 135, and 137 that extend parallel to the lateral axis 294 (FIG. 2). The longitudinal wall 130 and a section of the longitudinal wall 134 oppose each other across a body portion 140 of the cavity 106. The longitudinal wall 132 opposes another section of the longitudinal wall 134 across a wing portion 142 of the cavity 106, and the longitudinal wall 136 opposes another section of the longitudinal wall 134 across a wing portion 144 of the cavity 106. In one embodiment, the cavity 106 includes only the body portion 140 and opposing wing portions 142 and 144. Also shown, the cavity 106 and mating face 118 may form shoulder portions 154 and 156 proximate to the top side $S_1$. The shoulder portions 154 and 156 jut into the cavity 106 and facilitate preventing the shroud 310 from being advanced into the cavity 106 if the plug connector 104 is not in the proper orientation or properly aligned with the receptacle connector 102. Also shown in FIG. 3, the walls 130-135 meet each other at cavity corners 181-188.

FIG. 2 also illustrates that the receptacle connector 102 may include a contact module 125 positioned within the cavity 106 for holding an array of the pin contacts 160. (For illustrative purposes, the contact module 125 and the pin contacts 160 are not shown in FIG. 3.) The pin contacts 160 are arranged in an array and extend outward from the contact module 125 toward the opening 110 along the central axis 290. The pin contacts 160 may be arranged in any desired array. Although the illustrated embodiment shows several pin contacts 160, alternative embodiments may include only one pin contact. Also, alternative embodiments may include more than one type of mating contact or include other mateable components. Furthermore, the contact module 125 may be held within the cavity 106 as described in U.S. patent application Ser. No. 12/257,132.

In the illustrated embodiment, a substantial portion of the cavity 106 (e.g., the body portion 140) is substantially open or unobstructed such that the cavity 106 does not have walls or projections extending into the cavity 106 in front of the pin contact module 125. For example, the cavity 106 may have a uniform width $W_1$ and height $H_1$ through the body portion 140. Moreover, the array of pin contacts 160 may be distributed substantially evenly and continuously across the body portion 140 of the cavity 106. The array of pin contacts 160 may be arranged in a row-and-column formation where the rows extend substantially longer than the columns. By way of example, the pin contacts 160 may include two rows of ten pin contacts 160 that are evenly distributed with respect to each other. Because the cavity 106 is substantially open and unobstructed, the connector assembly 100 (FIG. 1) may provide a greater density and number of pin contacts 160 than known connector assemblies.

Also shown in FIGS. 2 and 3, the opposing longitudinal walls 130 and 134 may each include one or more channels 161-165. Specifically, the longitudinal wall 130 includes the channels 161 and 162, which have channel openings 170, and the opposing longitudinal wall 134 includes the channels 163-165, which also have channel openings 170. Each channel 161-165 extends from the mating face 118 or opening edge 120 of the mating end 108 into the cavity 106 along the central axis 290 in a substantially linear direction. Each channel 161-165 may include an opening gap $G_1$ at the respective channel opening 170 (only shown with respect to the channel 161) at the mating face 118. The gap $G_1$ narrows to a channel gap $G_2$ as the corresponding channel extends into the cavity 106.

The channels 161-165 may be positioned and spaced apart from each other in order to prevent scooping of the pin contacts 160 and may also be positioned to facilitate properly orienting and aligning the receptacle connector 102 and the plug connector 104 before mating with each other. More specifically, the channel 163 is spaced apart a distance $D_2$ from the lateral wall 133, and the channel 165 is spaced apart a distance $D_3$ from the lateral wall 135. The distances $D_2$ and $D_3$ oriented to prevent the shroud 310 from being inserted into the cavity 106 and damaging the pin contacts 160 when erroneously aligned. Furthermore, the channel 161 is spaced apart a distance $D_3$ from the lateral wall 133, and the channel 162 is spaced apart a distance $D_5$ from the lateral wall 135. In the illustrated embodiment, the distance $D_4$ is greater than the distance $D_2$ such that the channels 161 and 163 are not aligned with each other. Likewise, the distance $D_5$ is greater than the distance $D_3$ such that the channels 162 and 165 are not aligned with each other.

Moreover, the longitudinal walls 130 and 134 may include an unequal number of channels with respect to each other. For example, the longitudinal wall 130 may include two channels 161 and 162 while the longitudinal wall 134 may include three channels 163-165. The unequal number of channels and/or the spacing between the channels may facilitate orienting the receptacle and plug connectors 102 and 104 into the proper vertical or lateral position before mating the connectors.

Figure 4:
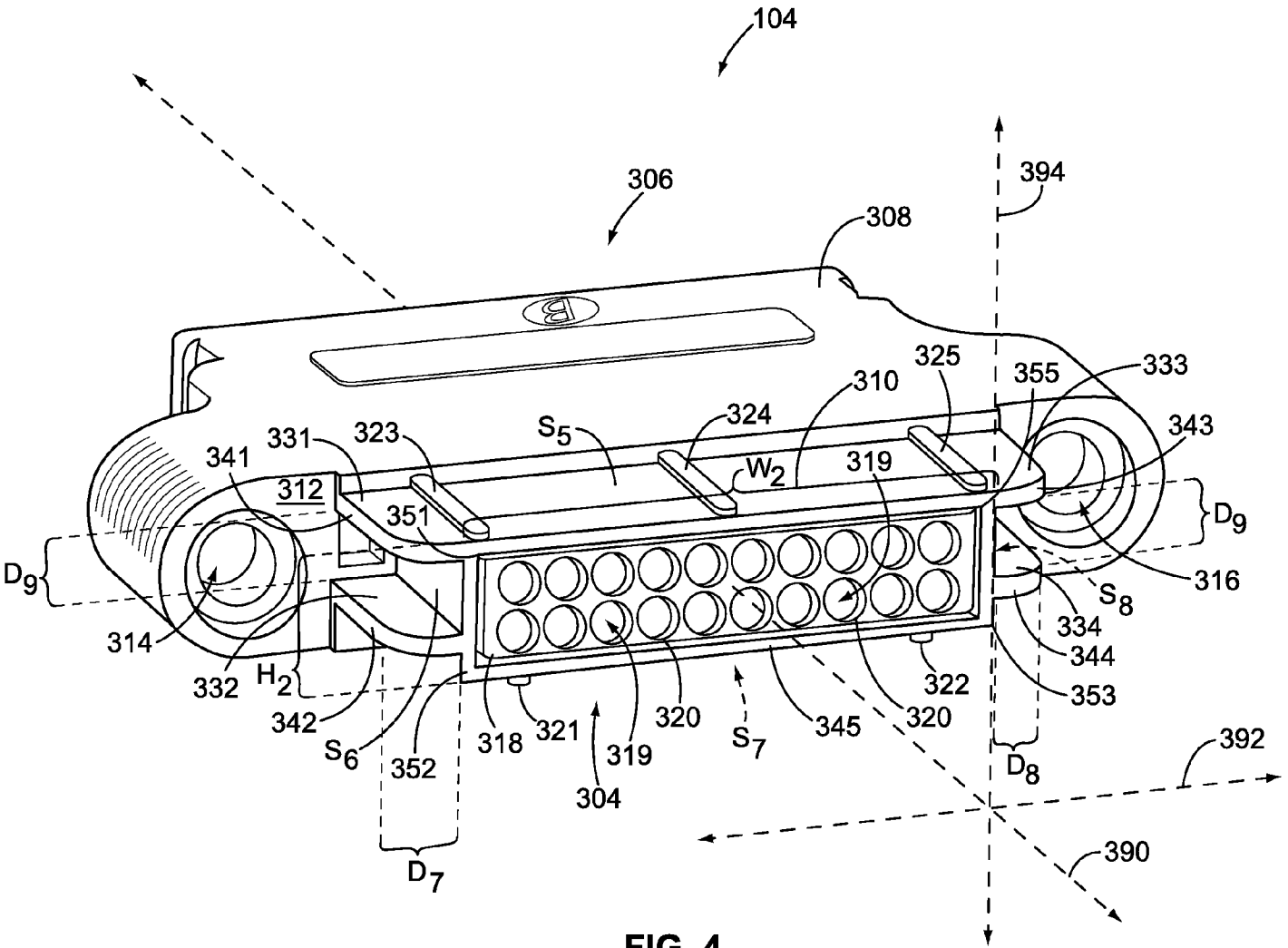
FIG. 4 is a front perspective view of a plug connector that may be used with the connector assembly shown in FIG. 1.

FIG. 4 is a front perspective view of the plug connector 104 that is oriented with respect to a central axis 390, a longitudinal axis 392, and a lateral axis 394. The plug connector 104 extends along the central axis 390 and includes a front mating end 304 and a back end 306. The plug connector 104 includes a housing or connector body 308 that has a base surface 312 proximate to the mating end 304 extending parallel to a plane formed by the longitudinal and lateral axes 392 and 394. Like the housing 116 (FIG. 2), the connector body 308 may be assembled from separate parts (e.g., two shells) or, alternatively, may be integrally formed/molded. The plug connector 104 includes a shroud 310 projecting from the base surface 312 along the central axis 390. Also shown in FIG. 4, the base surface 312 may form holes 314 and 316 that are configured to engage a fastener and cooperate with one of the fastener mounts 122 and 124 of the receptacle connector 102 to maintain a coupling between the receptacle and plug connectors 102 and 104.

The shroud 310 is formed from a plurality of sides $S_5$-$S_8$ that include longitudinal sides $S_5$ and $S_7$ that extend parallel to a plane formed by the longitudinal and central axes 392 and 390. The sides $S_5$-$S_8$ also include lateral sides $S_6$ and $S_8$ that extend parallel to a plane formed by the lateral and the central axes 394 and 390. The shroud 310 may include a socket module 318 that has one or more apertures 320 for holding a plug contact (not shown) therein. Each aperture 320 receives a corresponding pin contact 160 (FIG. 2) when the receptacle and plug connectors 102 and 104 are engaged. The socket module 318 may be held within a cavity formed by the plurality of sides $S_5$-$S_8$ or, alternatively, may be integrally formed with the shroud 310 and the connector body 308.

The plurality of sides $S_5$-$S_8$ form a substantially rectangular structure that has a height $H_2$ and a width $W_2$. In the illustrated embodiment, the height 112 is substantially equal to the height $H_1$ of the cavity 106 (FIG. 3). The width $W_2$ may be substantially equal to a width of the body portion 140 (FIG. 3) such that the shroud 310 may slide in and out of the body portion 140. As shown, the longitudinal sides $S_5$ and $S_7$ extend substantially parallel to one another and intersect the lateral sides $S_6$ and $S_8$ at shroud corners 351-354. More specifically, the longitudinal side $S_5$ forms shroud corners 351 and 354 with the lateral sides $S_6$ and $S_8$, respectively, and the longitudinal side $S_7$ forms shroud corners 352 and 353 with the lateral sides $S_6$ and $S_8$, respectively. The shroud corners 352 and 353 are configured to fit within and slide along the cavity corners 181 and 188 (FIG. 3) when the shroud 310 is inserted into the cavity 106.

As discussed above, the shroud 310 is configured to be inserted into the cavity 106 of the receptacle connector 102. The shroud 310 may include a plurality of ribs 321-325 that project outwardly from the longitudinal sides $S_5$ and $S_7$ and a plurality of wing guides 331-334 that project outwardly from the lateral sides $S_6$ and $S_8$. Each wing guide 331-334 includes a guide edge 341-344, respectively, that defines the shape of the corresponding wing guide. The ribs 321-325 extend from a front-to-back direction along the central axis 390 on the corresponding side. The longitudinal side $S_5$ includes the ribs 321-323 and the longitudinal side $S_7$ includes the ribs 324 and 325. Each rib 321-325 may have a rounded tip 327. The ribs 321-325 are spaced apart from each other and are configured to be inserted into and slide along the channels 161-165, respectively, when the receptacle and plug connectors 102 and 104 are properly aligned on the mating axis 190 (FIG. 1) and engaged with each other.

The ribs 321-325 may be configured relative to a corresponding wing guide 331-334. For example, with reference to the corner 351, the rib 323 is positioned proximate to the corner 351 and the wing guide 331 is also positioned proximate to the corner 351. As shown, the rib 323 and the wing guide 331 project outwardly in directions that are generally perpendicular to each other. Furthermore, in the illustrated embodiment, the wing guides 331 and 333 extend from the lateral sides $S_6$ and $S_8$, respectively, such that the wing guides 331 and 333 are flush or even with the longitudinal side $S_5$.

The wing guides 331 and 332 project from the lateral side $S_6$ a distance $D_7$, and the wing guides 333 and 334 project from the lateral side $S_8$ a distance $D_8$. The pair of wing guides 331 and 332 and the pair of wing guides 333 and 334 may be spaced apart from each other a distance $D_9$. When the shroud 310 is inserted into the cavity 106, the wing guide 331 slides along the longitudinal wall 134 and the wing guide 332 slides along the longitudinal side 132. Both of the guide edges 341 and 342 slide along the lateral wall 133. Likewise, the wing guides 333 and 334 are spaced apart from each other and slide along the longitudinal walls 134 and 136, respectively, when the shroud 310 is inserted into the cavity 106. Both of the guide edges 343 and 344 slide along the lateral wall 135.

As discussed above the wing guides 331 and 332 (or the wing guides 333 and 334) may be spaced apart from each other a distance $D_9$. When the shroud 310 is inserted into the cavity 106, the distance $D_9$ may be configured to allow a key (not shown) to be inserted between the corresponding wing guides. Alternatively, the shroud 310 may not have a pair of wing guides that projects from one side but may have one large wing guide that spans the length of the corresponding lateral side.

Furthermore, the plurality of sides $S_5$-$S_8$ may form a mating edge 345 at the mating end 304 of the shroud 310. The mating edge 345 lies on a mating plane 347 (indicated as a hashed line in FIG. 5) that is parallel to the longitudinal and lateral axes 392 and 394. In one embodiment, the guide edges 341-344 may initially project from the mating edge 345 such that the mating edge 345 is co-planar with the guide edges 341-344. The guide edges 341-344 may then curve away from the mating end 304 toward the back end 306 and then extend substantially parallel to the central axis 390.

Figure 5:
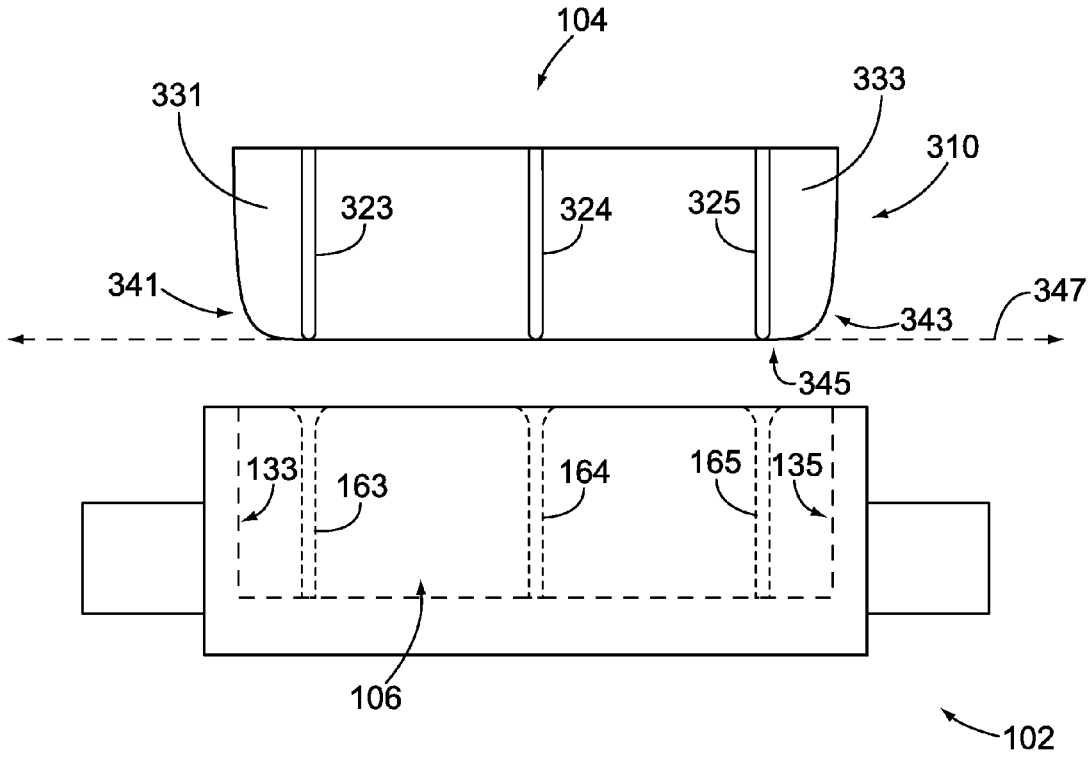
FIG. 5 is a bottom planar view of the connector assembly shown in FIG. 1.

FIG. 5 is a bottom planar view of the connector assembly 100 before the receptacle and plug connectors 102 and 104 are engaged. Although the description herein describes the plug connector 104 as being moved toward and inserted into the receptacle connector 102, those skilled in the art understand that the receptacle connector 102 may be moved toward and inserted over the plug connector 104. When the receptacle and plug connectors 102 and 104 are properly aligned, the cavity 106 and the shroud 310 are laterally and longitudinally aligned with each other. As such, the ribs 321-325 are aligned with the corresponding channels 161-165, respectively. When the shroud 310 is inserted into the cavity 106, the wing guides 331 and 333 move alongside the lateral walls 133 and 135, respectively. The socket module 318 (FIG. 4) and the corresponding socket contacts 319 (FIG. 4) are then properly aligned with the pin contacts 160 (FIG. 2) within the cavity before the pin contacts 160 and the socket contacts 319 engage each other.

Figure 6:
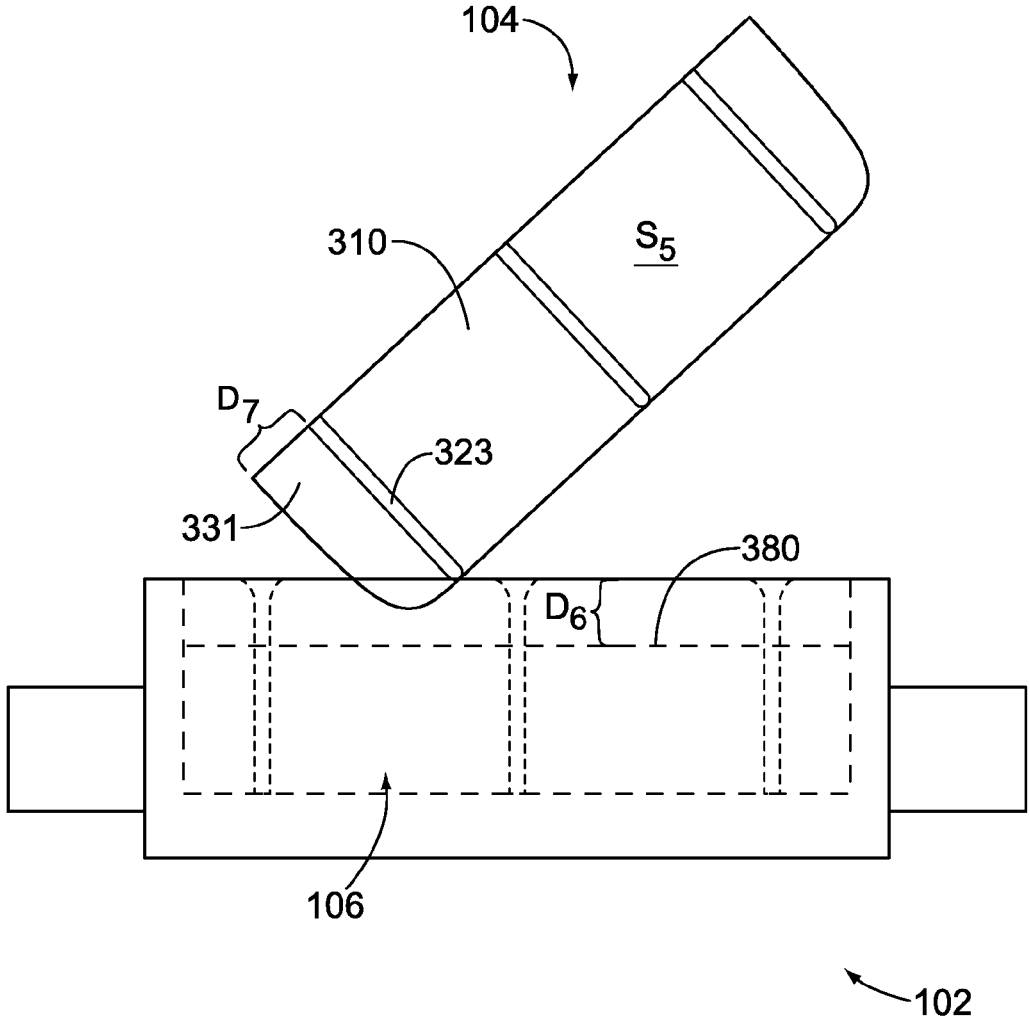
FIG. 6 is a bottom planar view of the connector assembly when the receptacle and plug connectors are erroneously aligned.
Figure 7:
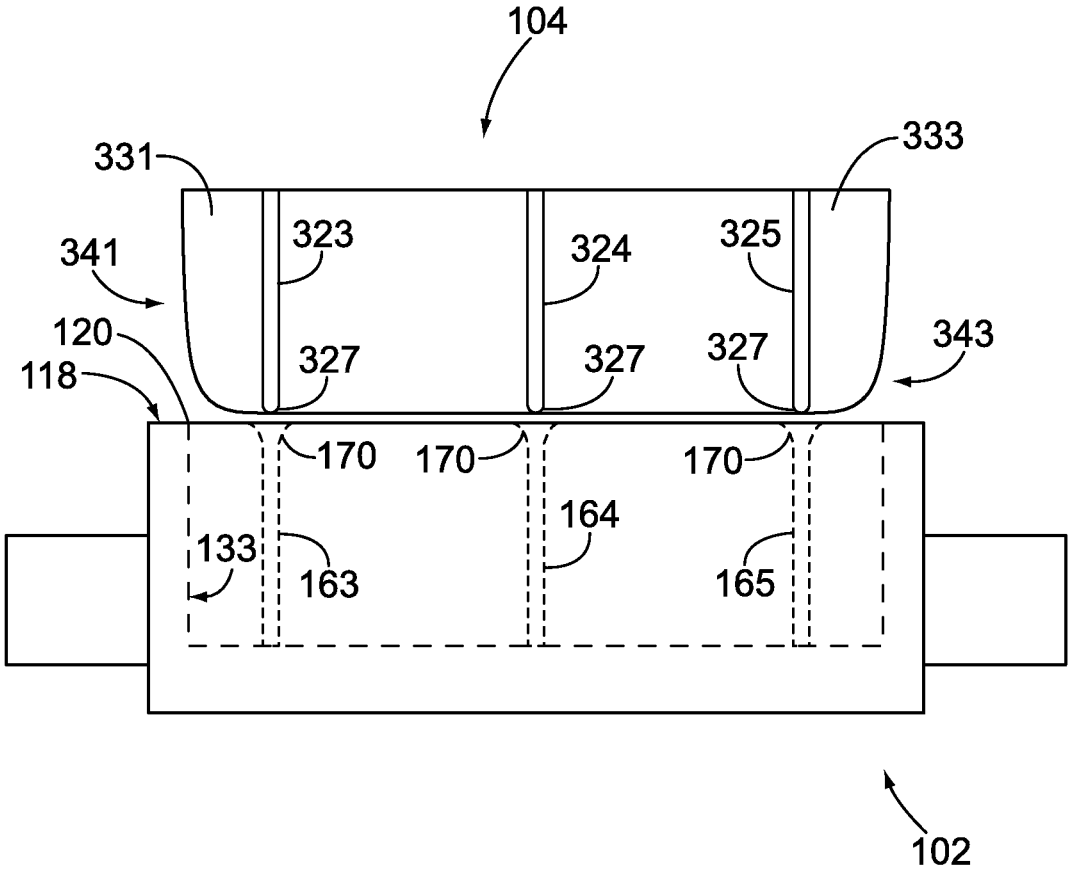
FIG. 7 is a bottom planar view of the connector assembly when the receptacle and plug connectors are longitudinally misaligned.

FIGS. 6 and 7 are bottom planar views of the receptacle and plug connectors 102 and 104 when the two are misaligned. FIG. 6 illustrates when the shroud 310 of the plug connector 104 is oriented such that the wing guide 331 is inadvertently inserted into the cavity 106. As shown, the pin contacts 160 (FIG. 2) are a depth $D_6$ into the cavity 106. (The hashed line 380 indicates the positions of the tips of the pin contacts 160 within the cavity 106.) Various parts of the shroud 310 and the receptacle connector 102 may be configured to prevent scooping of the pin contacts 160 by the shroud 310. For example, the distance $D_7$ projected by the wing guide 331 from the lateral side $S_6$ (FIG. 4), the position of the rib 323 along the longitudinal side $S_5$, and the depth $D_6$ may all be configured with respect to each other to prevent scooping. Thus, when the shroud 310 is erroneously inserted into the cavity 106, the rib 323 provides a positive stop and prevents the shroud 310 or, more specifically, the wing guide 331 from penetrating further into the cavity 106 and damaging the pin contacts 160.

FIG. 7 illustrates when the shroud 310 and the receptacle connector 102 are slightly longitudinally misaligned. As shown, before the shroud 310 is inserted into the cavity 106, the shroud 310 may be slightly misaligned with the cavity 106. For example, the receptacle connector 102 and the shroud 310 may have different longitudinal positions such that the rounded tips 327 of the ribs 321-325 engage the mating face 118 of the receptacle connector 102 or a curved portion of the channel openings 170. Furthermore, the guide edge 341 of the wing guide 331 may engage the opening edge 120 formed by the lateral wall 133 and the mating face 118. As such, the rounded tips 327 and the guide edges 331 and 333 may be configured to cooperate with each other to shift the shroud 310 in a longitudinal direction when the shroud 310 is longitudinally misaligned with the cavity 106.

Embodiments described herein may be electrical connectors, connectors that interconnect optical fibers, or optoelectronic connectors. As such, the phrase "conductors and/or cables" or the phrase "at least one of conductors and cables" includes electrical wires, conductors, or cables that transmit electrical signals or power or electrical signals and power, as well as optical fibers or cables used for transmitting signals in fiber-optic communication.

In some embodiments, the connector assembly 100 may be configured for many applications, such as high-speed telecommunications equipment, various classes of servers, and data storage and transport devices. The connector assembly 100 may perform at high speeds and maintain signal integrity while withstanding vibrations and shock that may be experienced during, for example, aerospace or military operations. However, embodiments described herein are not limited to applications for extreme environments, but may also be used in other environments, such as in an office or home. The preceding description of the receptacle and plug connectors 102 and 104 is provided for illustrative purposes only, rather than limitation, and the illustrated embodiment is but one application that may be used with the features and mechanisms described herein.

While the illustrated embodiment described above is designed for a specific orientation when mounted or mated with another connector, alternative embodiments may have other configurations. As such, the terms front, back (or rear), top, bottom, upper, lower, upward, downward, inward and the like are relative and based on the orientation of the illustrated embodiment, and are not intended to be restrictive.

Furthermore, the contact module 125 and the socket module 318 may be interchangeable between connector body 308 and receptacle housing 116. As such, the aforementioned discussion may be also applicable to pin contacts 160 in connector bodies that are mated and demated to socket contacts 319 in receptacle housings. Embodiments made and used as described herein apply to both sets of configurations. Furthermore, more than one contact module 125 and more than one socket module 318 may be used in alternative embodiments.

Thus, it is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. For example, generally a "connector," as may be used in the following claims, may either be a plug connector or a receptacle connector, such as the plug and receptacle connectors 104 and 102 described above, unless specified otherwise. Likewise, a "first connector" or a "second connector," as may be used in the following claims, may either be a plug or receptacle connector, such as the plug and receptacle connectors 104 and 102 described above, unless otherwise specified. Furthermore, a "mating contact," as may be used in the following claims, includes pin contacts and socket contacts, such as the pin contacts 160 and socket contacts 319 shown and described above. Also, a mating contact may be an electrical contact or a terminus for an optical fiber.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly comprising:

a plug connector extending along a mating axis from a front mating end, the plug connector comprising:

a connector body having a shroud including a longitudinal side and a lateral side meeting at a shroud corner, the longitudinal and lateral sides extending along the mating axis;

socket contacts received in the shroud;

a rib projecting away from the longitudinal side, the rib having a position proximate to the shroud corner;

a wing guide projecting a distance from the lateral side to a distal end and being positioned proximate to the shroud corner, the rib and the wing guide extending in directions that are generally perpendicular to each other; and a receptacle connector having walls defining a cavity, the receptacle connector including a mating end with an opening for accessing the cavity and pin contacts arranged therein, the cavity having a complementary shape configured to receive the connector body, the walls of the receptacle connector directing the connector body into the cavity such that the socket contacts engage and mate with the pin contacts, wherein the position of the wing guide and the position of the rib are configured to prevent the pin contacts from being damaged when the connector body is erroneously inserted into the receptacle connector.

2. The connector assembly in accordance with claim 1 wherein the wing guide includes a guide edge, the guide edge initially projecting from the lateral side in a substantially perpendicular direction with respect to the mating axis and then curving away from the mating end.

3. The connector assembly in accordance with claim 1 wherein the wing guide projects from the lateral side at the shroud corner such that the wing guide is flush with the longitudinal side.

4. The connector assembly in accordance with claim 1 wherein the longitudinal side is a first longitudinal side and the shroud further comprises a second longitudinal side that opposes the first longitudinal side, each longitudinal side having an unequal number of ribs with respect to the other longitudinal side.

5. The connector assembly in accordance with claim 1 wherein the shroud includes a mating edge that extends along a plane, the longitudinal and lateral sides extending from the edge, wherein the rib and the wing guide initially project from the edge on the plane.

6. The connector assembly in accordance with claim 1 further comprising a contact module positioned within the cavity, the contact module holding the pin contacts.

7. The connector assembly in accordance with claim 1 wherein the pin contacts are located a depth into the cavity, the wing guide and the rib being configured to prevent the plug connector from extending the depth into the cavity when erroneously inserted.

8. The connector assembly in accordance with claim 1 wherein the pin contacts are arranged in an array and are distributed evenly and continuously across a substantial portion of the cavity.

9. The connector assembly in accordance with claim 1 wherein the wing guide is a first wing guide and the plug connector further comprises a second wing guide projecting from the lateral side in a common direction with the first wing guide, the first and second wing guides being spaced apart from each other a distance.

10. The connector assembly in accordance with claim 1 wherein the walls include a pair of longitudinal walls that oppose each other across the cavity, wherein the longitudinal walls are generally planar and include a channel for receiving the rib.

11. A connector assembly comprising:

a receptacle connector having a front mating end and a back end and a cavity extending therebetween, the cavity having pin contacts therein and being defined by a longitudinal wall and a lateral wall meeting each other at a cavity corner, the longitudinal wall forming a channel that extends alongside the cavity; and a plug connector comprising:

a connector body having a shroud including socket contacts configured to engage the pin contacts when the receptacle and plug connectors are properly mated, the shroud including a longitudinal side and a lateral side meeting at a shroud corner, the shroud corner being configured to slide along the cavity corner;

a rib projecting away from the longitudinal side and being configured to slide within the channel of the receptacle connector; and a wing guide projecting a distance from the lateral side to a guide edge, the rib and the wing guide extending in directions that are generally perpendicular to each other, the guide edge being curved such that the guide edge facilitates shifting the plug connector from a longitudinally misaligned position in which the rib is misaligned with the channel to a longitudinally aligned position in which the rib is aligned with the channel.

12. The connector assembly in accordance with claim 11 wherein the guide edge initially projects from the lateral side in a substantially perpendicular direction and then curves away to extend substantially parallel to the lateral side.

13. The connector assembly in accordance with claim 11 wherein the wing guide projects from the lateral side at the shroud corner such that the wing guide is flush with the longitudinal side.

14. The connector assembly in accordance with claim 11 wherein the rib has a tip at the mating end that is rounded, wherein the tip of the rib and the guide edge are configured to cooperate with each other to align the plug connector when the plug connector is longitudinally misaligned with the receptacle connector.

15. The connector assembly in accordance with claim 11 wherein the channel includes a channel opening at the mating end for accessing the channel, the channel having a gap that narrows as the channel extends away from the mating end toward the back end.

16. The connector assembly in accordance with claim 11 wherein the receptacle connector further comprises a contact module positioned within the cavity, the contact module holding the pin contacts.

17. The connector assembly in accordance with claim 11 wherein the pin contacts are located a depth into the cavity, the wing guide and the rib being configured to prevent the plug connector from extending the depth into the cavity when the plug connector is erroneously inserted into the receptacle connector.

18. The connector assembly in accordance with claim 11 wherein the pin contacts are arranged in an array and are distributed evenly and continuously across a substantial portion of the cavity.

19. The connector assembly in accordance with claim 11 wherein the wing guide is a first wing guide and the plug connector further comprises a second wing guide projecting from the lateral side in a common direction with the first wing guide, the first and second wing guides being spaced apart from each other.

20. The connector assembly in accordance with claim 11 wherein the longitudinal wall is a first longitudinal wall and the receptacle connector further comprises a second longitudinal wall that opposes the first longitudinal wall, wherein the longitudinal walls are generally planar.

* * * * *